US012410917B2

(12) United States Patent
Beliveau et al.

(10) Patent No.: US 12,410,917 B2
(45) Date of Patent: Sep. 9, 2025

(54) DOMESTIC APPLIANCE, OPERATING ELEMENT FOR A DOMESTIC APPLIANCE, AND METHOD FOR CONTROLLING A DOMESTIC APPLIANCE

(71) Applicant: BSH Hausgeräte GmbH, Munich (DE)

(72) Inventors: Thomas Eric Beliveau, Munich (DE); Tobias Schmidt, Munich (DE); Elena Leinmüller, Ottobrunn (DE)

(73) Assignee: BSH Hausgeräte GmbH, Munich (DE)

( * ) Notice: Subject to any disclaimer, the term of this patent is extended or adjusted under 35 U.S.C. 154(b) by 1692 days.

(21) Appl. No.: 16/348,517

(22) PCT Filed: Nov. 23, 2017

(86) PCT No.: PCT/EP2017/080217
§ 371 (c)(1),
(2) Date: May 9, 2019

(87) PCT Pub. No.: WO2018/104066
PCT Pub. Date: Jun. 14, 2018

(65) Prior Publication Data

US 2019/0277510 A1 Sep. 12, 2019

(30) Foreign Application Priority Data

Dec. 7, 2016 (DE) ..... 102016224302.0

(51) Int. Cl.
*F24C 7/08* (2006.01)

(52) U.S. Cl.
CPC ..... *F24C 7/083* (2013.01); *F24C 7/086* (2013.01)

(58) Field of Classification Search
CPC .. F24C 7/08; F24C 7/083; F24C 7/086; F24C 7/082; F24C 15/2021; F24C 3/124;
(Continued)

(56) References Cited

U.S. PATENT DOCUMENTS 6,153,837 A * 11/2000 Garcia ..... F24C 7/083 200/18
6,812,435 B2 * 11/2004 Schilling ..... H01H 25/008 219/508
(Continued)

FOREIGN PATENT DOCUMENTS

DE 102006026187 A1 12/2007
DE 102011007471 A1 10/2012
(Continued)

OTHER PUBLICATIONS

National Search Report DE 10 2016 224 302.0 Dated Aug. 24, 2017.
International Search Report PCT/EP2017/080217 dated Mar. 14, 2018.

*Primary Examiner* — Chris Q Liu
(74) *Attorney, Agent, or Firm* — Michael E. Tschupp; Andre Pallapies; Brandon G. Braun

(57) ABSTRACT

A household appliance includes an operating region for controlling the household appliance, and an operating element configured for attachment on the operating region by magnetic force and removal therefrom and being movable relative to the operating region. The operating element includes an outer element and an inner element which is rotatable relative to the outer element. The inner element includes a user interface element and a magnetic body, by which the inner element can be aligned relative to the outer element by a predefined magnetic field.

24 Claims, 6 Drawing Sheets

(58) Field of Classification Search
CPC ..... F24C 3/126; F24C 7/085; H01H 36/00; H01H 25/008; H01H 25/04; H01H 36/0066; H01H 25/06; H01H 5/02; H01H 25/002; H01H 27/00; H01H 3/0213; H01F 7/02; H01F 7/0247; H05B 3/74
USPC ..... 219/457.1, 491, 507, 508, 625, 660, 663
See application file for complete search history.

(56) References Cited

U.S. PATENT DOCUMENTS

| | | | | |
|---|---|---|---|---|
| 9,093,237 | B2 | 7/2015 | Bondar | |
| 2001/0008237 | A1* | 7/2001 | Essig | H05B 3/74 219/482 |
| 2003/0178290 | A1 | 9/2003 | Schilling | |
| 2003/0178291 | A1 | 9/2003 | Schilling | |
| 2005/0089809 | A9* | 4/2005 | Repper | F24C 3/126 431/66 |
| 2005/0189820 | A1* | 9/2005 | Blumenthal | F24C 7/083 307/104 |
| 2013/0200965 | A1* | 8/2013 | Bondar | F24C 7/083 335/219 |
| 2015/0308694 | A1* | 10/2015 | Christiansen | F24C 7/083 219/626 |

FOREIGN PATENT DOCUMENTS

| | | | |
|---|---|---|---|
| DE | 102012213693 | A1 | 2/2014 |
| DE | 102013212814 | A1 | 1/2015 |
| EP | 2251762 | A2 | 11/2010 |
| WO | 2008003572 | A2 | 1/2008 |
| WO | 2010143244 | A1 | 12/2010 |
| WO | 2012080156 | A1 | 6/2012 |
| WO | 2016078893 | A1 | 5/2016 |

* cited by examiner

DOMESTIC APPLIANCE, OPERATING ELEMENT FOR A DOMESTIC APPLIANCE, AND METHOD FOR CONTROLLING A DOMESTIC APPLIANCE

CROSS-REFERENCES TO RELATED APPLICATIONS

This application is the U.S. National Stage of International Application No. PCT/EP2017/080217, filed Nov. 23, 2017, which designated the United States and has been published as International Publication No. WO 2018/104066 A1 and which claims the priority of German Patent Application, Serial No. 10 2016 224 302.0, filed Dec. 7, 2016, pursuant to 35 U.S.C. 119 (a)-(d).

BACKGROUND OF THE INVENTION

The present invention relates to a household appliance, an operating element for a household appliance and a method for controlling a household appliance with such an operating element.

Known household appliances, such as cooking appliances for example, are operated by means of a touch-sensitive input surface, which is also equipped with display elements for example to display an operating mode of the household appliance. The advantage of such an operating element is for example that the surface of the cooking appliance is easy to clean. However, many users prefer haptic operating elements, in particular rotary knobs, for setting a cooking temperature or cooking time for example.

DE 10 2012 213 693 A1 describes a two-part operating element, which can be positioned on such an input surface, its top being supported in a rotatable manner when in position. The operating element can be removed after use, thereby offering the advantages of the input surface described above as well as the advantages of a haptic operating element.

DE 10 2014 223 371 A1 describes a similar system, in which the touch-sensitive input surface is configured as a touchscreen. The touchscreen adjusts the displayed graphic user interface as a function of the position of the operating element.

Further conventional household appliances are known from WO 2010 143 244 A1, WO 2012 080 156 A1, DE 10 2011 007 471 A1, DE 10 2006 026 187 A1 and EP 225 17 62 A2.

BRIEF SUMMARY OF THE INVENTION

Against this background, one object of the invention is to propose a household appliance with an improved operating element.

According to a first aspect a household appliance with at least one operating region for controlling the household appliance and an operating element is proposed. The operating element can be held on the operating region by means of magnetic force and can be moved relative to the operating region. The operating element can also be positioned in such a manner that it can be removed from the operating region. The operating element has an inner element and an outer element. The inner element can be rotated relative to the outer element and has a user interface element and a magnetic body. The inner element can be aligned relative to the outer element by the magnetic body by means of a predefined magnetic field.

Such a household appliance has the advantage, in particular, that a number of operating regions can be provided on the household appliance, being arranged differently for example, perhaps horizontally or vertically, and each able to be operated using the one operating element. The operating element here allows a haptic user experience. It also ensures that the user interface element of the inner element of the operating element is always correctly aligned by the predefined magnetic field. This generally facilitates operation of the household appliance, reducing the probability of incorrect operation.

The at least one operating region is preferably an essentially flat sub-surface of an outer surface of the household appliance. For example, a household appliance can have one operating region on its upper face and/or its front face respectively. The operating region is also preferably integrated in the respective outer surface of the household appliance so there are no intrusive transitions and/or edges between the outer surface and the operating region. The operating region is designed to control the household appliance. To this end, the operating region has input and output elements for example. These are, for example, buttons, switches, rotary controls, slide controls and/or touch-sensitive input elements. The operating region also has output elements, which include, for example, an LED (light emitting diode), segment display and/or LCD (liquid crystal display). The output elements are designed, in particular, to display a current operating state of the household appliance. The current operating state includes for example information relating to functions currently in use, set temperatures and/or power values, a set cooking time and/or further parameters relating to the household appliance. The household appliance also has an electronic control system (not described in detail), which is designed, in particular, to process inputs by way of the operating region, to activate the operating region to output operating parameters and to activate the functional units of the household appliance, such as a hotplate and/or heating coil for example.

The operating element is designed, in particular, to operate the operating region. It has a two-part structure comprising the inner element and the outer element. The inner element is configured as an operating element base, for example, and the outer element is configured as an operating element top, the two elements being connected by way of a ball bearing for example, and therefore, being able to be rotated relative to one another. The operating element base preferably has a flat lower face, which can be positioned on the operating region. The flat surface means there is a large contact surface with the operating region, ensuring that the operating element sits securely on the operating region. The operating element can be used, in particular, as a rotary control when it is arranged on the operating region. It is therefore possible to dispense with other rotary controls arranged permanently on the operating region, thereby enhancing the user-friendliness of the household appliance.

A retaining force for the operating element, which holds the operating element securely on the operating region, for example when the operating region is arranged vertically on the front face of the household appliance, is provided by a magnetic force between the operating element and the operating region. To this end the operating region comprises for example a magnetizable material, so that a magnetic retaining force is established between the magnetic body of the operating element and the magnetizable material. Magnetic bodies can also be provided in the operating region, for example to increase the magnetic retaining force and/or to predefine a magnetic field with a defined direction.

The magnetic body of the operating element is, in particular, a permanent magnet with a magnetic field, which is powerful enough to hold the operating element securely on the operating region. A magnet has a north pole and a south pole for example. Magnetic field lines form between the north pole and the south pole in permanently closed loops. The field lines, for example, run from the south pole to the north pole in a magnetic body and from the north pole to the south pole outside the magnetic body. A magnetic field can be described formally as a vector field, having a defined size and direction at every position. The field lines of a magnetic field show the local direction of the magnetic field, while the strength of the magnetic field is defined by the number of field lines running through a defined surface. If the magnetic fields of two magnetic bodies are overlaid, a magnetic force acts on the two magnetic bodies such that each tries to align itself along the field lines of the other magnetic body. It can also be said that a magnet with a magnetic field moved into a predefined magnetic field has a potential (magnetic) energy that it tries to minimize by alignment along the field lines of the predefined magnetic field. This alignment force is also referred to here as a magnetic orientation force. For this reason, the magnetic body of the operating element will also try to align itself correspondingly in a predefined magnetic field and with it the inner element of the operating element. Such alignment of the inner element takes place, in particular, relative to the outer element, which is held by a user for example.

The inner element of the operating element also has a user interface element. The user interface element is designed for example to display operating parameters of the household appliance and/or to receive user inputs for controlling the household appliance. The user interface element can comprise a touch-sensitive display for example. Because the inner element and with it the user interface element align themselves according to the predefined magnetic field, it is ensured that a graphic display on the user interface element for example can always be easily read by a user.

According to one embodiment of the household appliance, the at least one operating region and the user interface element of the operating element can be configured as a function of a position of the operating element relative to the operating region.

This embodiment has the advantage, in particular, that a display on the operating region and/or on the user interface element can be selected as a function of position and context. This ensures for example that a display element of the operating region is not covered by the operating element. A number of positions can also be provided on the operating region for example, with the operating element functioning as a rotary knob in a first position, the operating element functioning as a clock display in a second position and the operating element functioning as a selector switch to activate different functions of the household appliance in a third position.

According to a further embodiment of the household appliance the magnetic body of the operating element is configured as a ring magnet.

The ring magnet, in particular, has a diametrical arrangement of its two poles. The cylindrically symmetrical mass distribution of such a ring magnet means that it is particularly suitable for the operating element, for example a rotary knob. Such a ring magnet can also be oriented simply and reliably by means of a corresponding ring magnet.

According to a further embodiment of the household appliance the magnetic body of the operating element is configured as a bar magnet or a curved bar magnet.

A bar magnet can also be referred to as a magnet block.

A curved bar magnet is a bar magnet which does not run precisely straight but along a circle radius for example. Such a curved bar magnet does not have a contour with point symmetry, in particular. A curved bar magnet can also be referred to as a magnet segment.

According to a further embodiment of the household appliance, a number of magnetic bodies are provided in the operating element.

Provision can be made for example for two bar magnets to be arranged in the operating element. This allows complex incorporation situations to be achieved for example and/or a magnetic retaining and/or orientation force to be increased.

According to a further embodiment of the household appliance the at least one operating region has at least one predefining apparatus for predefining the magnetic field.

The predefining apparatus comprises for example permanently magnetic materials and/or at least one electromagnet. The operating region preferably has a number of predefining apparatuses. In particular, the operating region can have a specific predefining apparatus in different preferred positions for the operating element.

According to a further embodiment of the household appliance the at least one predefining apparatus for predefining the magnetic field is configured as a magnetic body corresponding to the magnetic body of the operating element.

A corresponding magnetic body here means that it has for example the same size and/or geometry as the magnetic body of the inner element of the operating element. If the magnetic body of the inner element of the operating element is configured as a bar magnet for example, the magnetic body of the predefining apparatus is preferably also configured as a bar magnet. Such corresponding configuration of the two magnetic bodies ensures a powerful magnetic retaining force and a powerful magnetic orientation force and therefore reliable alignment of the inner element of the operating element in the predefined magnetic field. It also defines a retaining position of the operating element on the operating region exactly, as the magnetic force between the two magnetic bodies also brings about exact positioning of the magnets relative to one another.

According to a further embodiment of the household appliance, the magnetic body of the operating element is configured as a diametrically magnetized ring magnet and the at least one predefining apparatus is configured as a diametrically magnetized cylindrical magnet.

This embodiment results in a particularly powerful magnetic retaining force with a powerful magnetic orientation force.

According to a further embodiment of the household appliance, the at least one predefining apparatus and the magnetic body of the operating element are matched to one another such that alignment of the inner element of the operating element by the predefined magnetic field takes place when the operating element is at a distance of 1 to 20 mm, preferably 5 to 15 mm, from the operating region.

This embodiment advantageously ensures that the inner element of the operating element is already aligned according to the predefined magnetic field when the operating element is positioned on the operating region, thereby ensuring a powerful magnetic retaining force. The operating element is practically prevented from falling down. It also allows exact positioning of the operating element, as the magnetic force pulls the operating element into a position exactly above the predefining apparatus, if the operating element is positioned for example slightly out of place.

According to a further embodiment of the household appliance the outer element of the operating element can be rotated relative to the inner element of the operating element when the operating element is positioned on the operating region.

In this embodiment the operating element can be used, in particular, as a rotary knob.

According to a further embodiment of the household appliance the user interface element has a display, which is designed to display at least one operating parameter of the household appliance graphically.

The automatic alignment of the inner element of the operating element when the operating element is positioned on the operating region advantageously ensures that the graphic display always has the correct orientation. This allows complex information, such as numbers, letters and/or words, also to be displayed on the display. In this embodiment it is advantageously possible to dispense with further graphic display elements, which are integrated for example in one of the operating regions. This reduces the complexity of the household appliance and can, in particular, help to reduce costs.

According to a further embodiment of the household appliance the display is configured as a touch-sensitive display.

As well as the advantages described above, this embodiment also has the further advantage that complex user inputs are also possible. For example, the touch-sensitive display can be designed to display one or more switches.

According to a further embodiment of the household appliance the inner element of the operating element has an energy supply apparatus to supply the user interface element with electrical energy.

The energy supply apparatus can comprise a battery, an accumulator and/or a charging facility for example. A charging facility includes different embodiments, such as contact-based embodiments and contactless embodiments.

According to a further embodiment of the household appliance the energy supply apparatus has two contact points, the operating region also having two corresponding contact points and the contact points being in electrical contact with the corresponding contact points when the operating element is positioned on the operating region.

According to a further embodiment of the household appliance the energy supply apparatus has a charging coil, the operating region also having at least one transmit coil, by means of which electrical energy can be transferred inductively to the charging coil.

In this embodiment the energy supply facility is configured contactlessly. This has the advantage, in particular, that there are no open contacts arranged on the household appliance and/or on the operating element, which could potentially represent a safety hazard. It also allows continuous operation without a user having to replace a battery for example. As the magnetic body of the inner element ensures alignment along the predefined magnetic field, the efficiency of the transfer by means of the inductive energy transfer is also advantageously ensured.

Provision can be made for example for the operating element to have an accumulator, which supplies the user interface element with electrical energy, when the operating element is used. A charging position for the operating element can also be provided, to which the operating element is moved when it is not in use and in which the accumulator is charged.

The household appliance is configured, in particular, as a cooking appliance, a cooktop, in particular an induction cooktop, an oven, a microwave, a grill and/or a steam cooking appliance.

According to a further aspect an operating element for operating a household appliance, in particular a household appliance according to one of the embodiments described above, is proposed. The operating element has an inner and outer element, the inner element being able to be rotated relative to the outer element and the inner element having a user interface element and a magnetic body. The inner element can be aligned relative to the outer element by the magnetic body by means of a predefined magnetic field.

Such an operating element has all the advantages described in relation to the embodiments of the household appliance described above.

According to one embodiment of the operating element it is configured as a removable rotary knob.

Such an embodiment has the advantage that a haptic operating experience is possible for users of the household appliance with this operating element.

According to a further aspect a method for controlling a household appliance with an operating region is proposed. The method comprises the following steps in particular: bringing an operating element toward the operating region, it being possible for the operating element to be held on the operating region by means of magnetic force and to be moved relative to the operating region and to be positioned in such a manner that it can be removed therefrom. The operating element has an inner element and an outer element, the inner element being able to be rotated relative to the outer element. The inner element has a user interface element and a magnetic body, by which the inner element can be aligned relative to the outer element by means of a predefined magnetic field; aligning the inner element of the operating element according to the predefined magnetic field; and positioning the operating element on the operating region to operate the household appliance. Operating the household appliance with the operating element, in particular, includes displaying an operating parameter of the household appliance and/or acquiring a user input to control the household appliance.

The embodiments and features described for the proposed apparatus apply correspondingly to the proposed method.

Further possible implementations of the invention comprise combinations of features or embodiments described above or in the following with regard to the exemplary embodiments even if these are not cited specifically. The person skilled in the art will also add individual aspects to improve or complete the respective basic form of the invention.

BRIEF DESCRIPTION OF THE DRAWINGS

Further advantageous configurations and aspects of the invention are set out in the subclaims and the exemplary embodiments of the invention described in the following. The invention is also described in more detail based on preferred embodiments with reference to the accompanying figures.

DETAILED DESCRIPTION OF EXEMPLARY EMBODIMENTS OF THE PRESENT INVENTION

Figure 1:
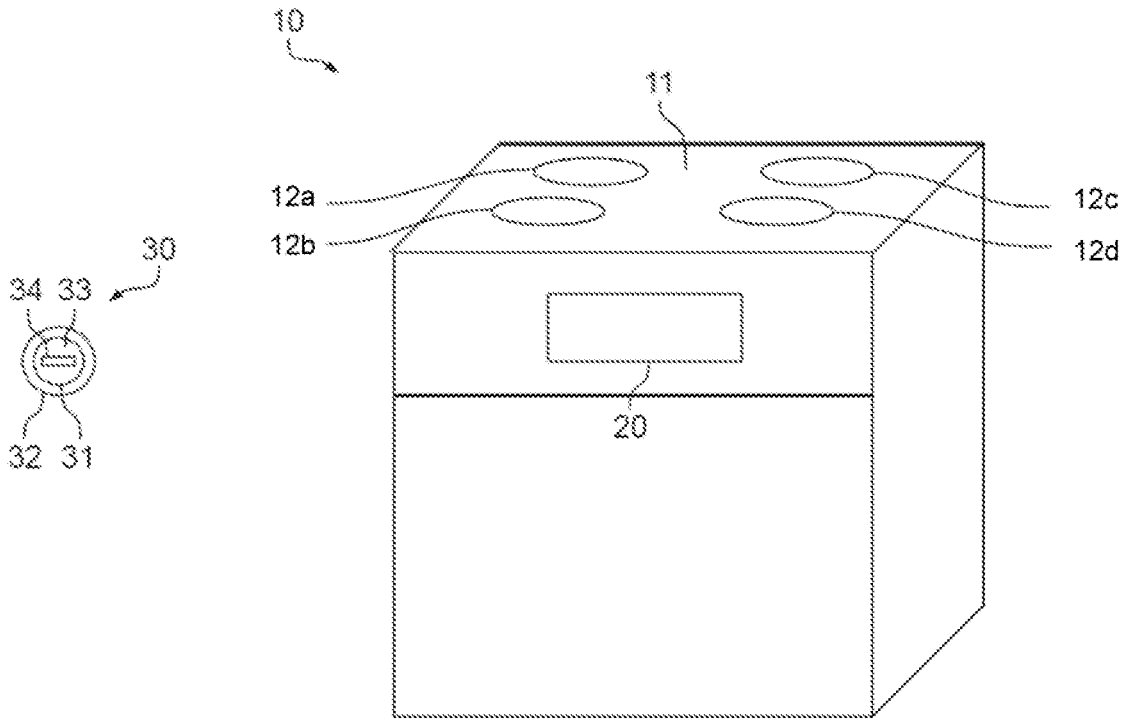
FIG. 1 shows a schematic view of an exemplary embodiment of a household appliance with an operating region and an operating element.

Identical elements or those of identical function are shown with the same reference characters in the figures, unless otherwise specified.

FIG. 1 shows a schematic view of a first exemplary embodiment of a household appliance 10. The household appliance 10 is configured here as a cuboid cooker comprising an oven (not shown) and a cooktop 11, which comprises four cooking zones 12*a*-12*d*. The household appliance 10 has a vertically arranged operating region 20 on its front face. An operating element 30 is shown next to the household appliance 10. The operating element 30 comprises an inner element 31 and an outer element 32. The inner element 31 has a user interface element 33 and a magnetic body 34. The operating element 30 here is configured as a round operating knob 30. The user interface element 33 is configured by way of example as an LCD and the magnetic body 34 is configured by way of example as a bar magnet.

The operating element 30 is positioned on the operating region 20 to operate the household appliance 10. Provision can be made for example for the operating element 30 to be positioned in the center of the operating region 20 to control the cooktop 11. A cooking zone 12*a*-12*d* of the cooktop 11 can now be selected first. To this end numbers from 1 to 4 are displayed on the user interface element 33 configured as an LCD of the operating element 30 for example, it being possible to switch between the numbers and therefore between the cooking zones 12*a*-12*d* by rotating the outer element 32. One of the cooking zones 12*a*-12*d* is selected by pressing the outer element 32 for example. A cooking stage is then selected for example by rotating the outer element 32. A circular segment display for example is displayed on the operating region 20 to show the cooking stage, being displayed as a function of a degree of rotation of the outer element 32. Alternatively or additionally, the set cooking stage can be displayed as a number from 0-9 or even from 0-100 on the user interface element 33 configured as an LCD of the operating element 30.

At the end of the cooking operation the operating element 30 can be removed from the operating region 20. This moves the household appliance 10 (e.g., cooker) into a rest mode, in which in particular all the cooking zones 12*a*-12*d* of the cooktop 11 are deactivated. The operating element 30 can then be moved for example into a standby position (not shown in detail), in which the user interface element 33 configured as an LCD can be used for example to display the current time.

Figure 2A:
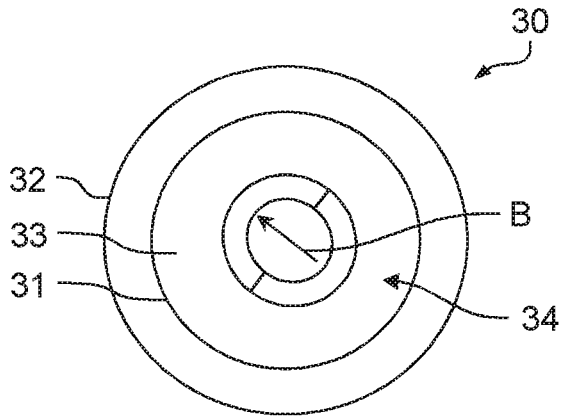
FIG. 2*a* shows a schematic plan view of an exemplary embodiment of an operating element with a ring magnet.

FIG. 2*a* shows a detailed view of an exemplary embodiment of the operating element 30. The operating element 30 comprises an inner element 31 and an outer element 32. The inner element 31 has a user interface element 33 (not shown here, see for example FIG. 1) and also a magnetic body 34 configured as a ring magnet. A preferred magnetic direction B of the magnetic body 34 configured as a ring magnet is shown by means of an arrow in FIG. 2*a*. The operating element 30 can have a different shape from the one in FIG. 2*a*. It can be configured as a block or a different, in particular regular, polygon for example.

Figure 2B:
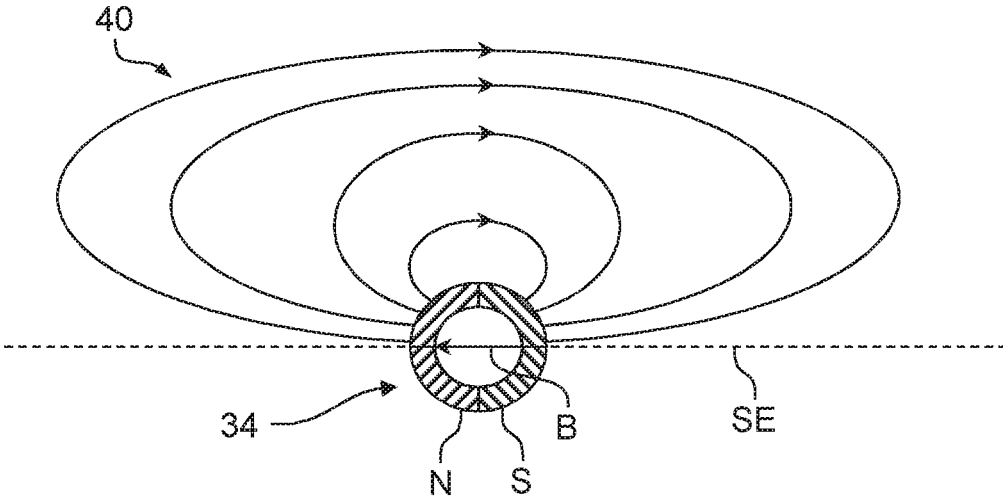
FIG. 2*b* shows a schematic section through a ring magnet with diametrically arranged poles and its magnetic field.

FIG. 2*b* shows a section through the magnetic body 34 configured as a ring magnet from FIG. 2*a*. The two magnetic poles N, S of the magnetic body 34 configured as a ring magnet are shown in particular and the magnetic field of the magnetic body 34 configured as a ring magnet is indicated by field lines 40. The field lines 40 have only been shown symbolically in the upper half plane here but the field pattern in the lower half plane can also be obtained by reflection along the plane of symmetry SE. The preferred direction B of the magnetic body 34 configured as a ring magnet is also shown.

Figure 3:
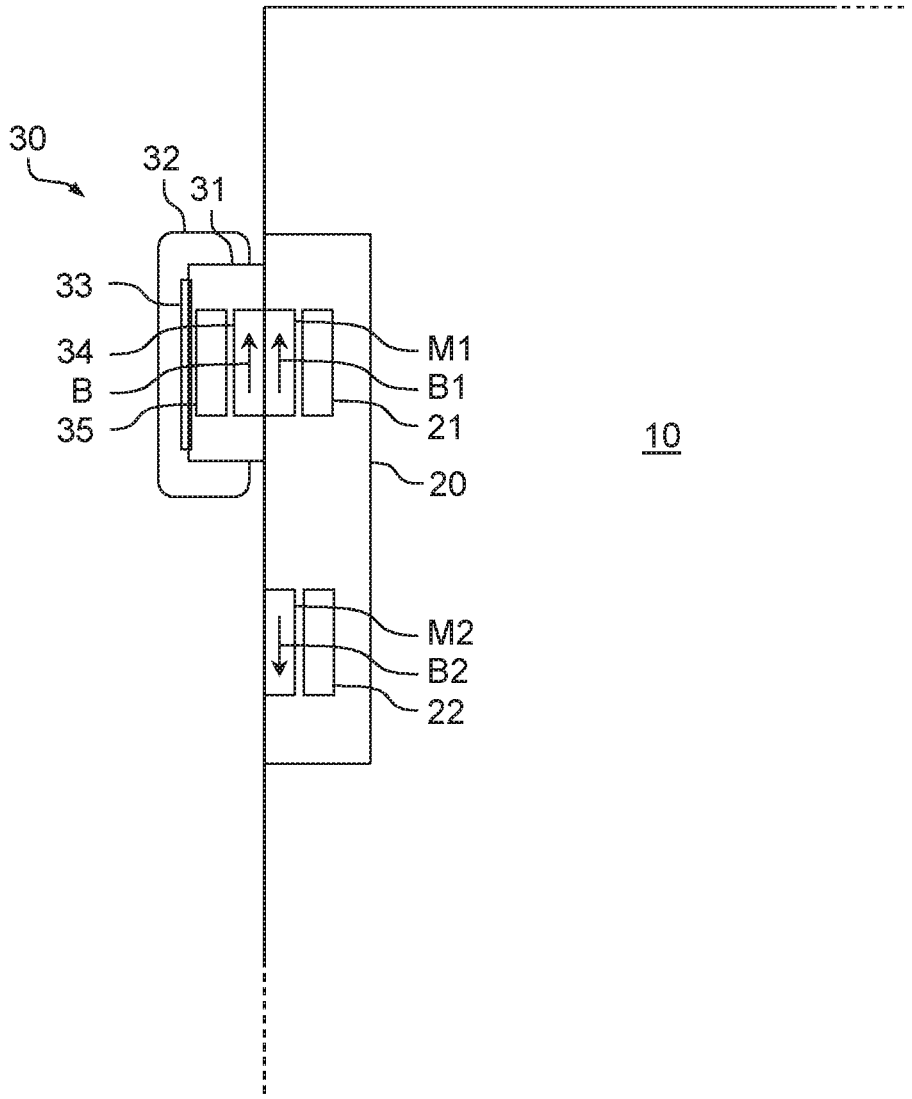
FIG. 3 shows a schematic section through an embodiment of the household appliance with a vertically arranged operating region and an operating element arranged thereon.

FIG. 3 shows a schematic view of a section through a further exemplary embodiment of a household appliance 10 with a vertically arranged operating region 20. The household appliance 10 in FIG. 3 is for example the household appliance 10 (e.g., cooker) from FIG. 1. The operating region 20 has two predefining apparatuses M1, M2 configured as magnetic bodies. Each magnetic body M1, M2 has its own magnetic field B1, B2, it being possible for the preferred direction of the different magnetic fields B1, B2 to be different. Each predefining apparatus M1, M2 is also assigned a transmit coil 21, 22 for transferring energy inductively to a charging coil 35. In the example in FIG. 3 the operating element 30 is arranged on the operating region 20 on the magnetic body M1. The operating element 30 has an inner element 31 and an outer element 32. The inner element 31 also has a user interface element 33 configured as an LCD, a magnetic body 34 with a preferred direction B and a charging coil 35.

The front face of the outer element 32, facing left in FIG. 3, is made for example of an at least partially transparent material such as glass or plastic, to allow the user interface elements 33 configured as LCDs to be read. In the example, the magnetic body 34 has aligned itself according to the magnetic field B1 predefined by the corresponding magnetic body M1. The alignment of the inner element 31 is therefore generally known, ensuring that a graphic display on the user interface element 33 configured as an LCD is correctly aligned and can therefore be read by a user. The charging coil 35 is designed to receive electrical energy inductively from the transmit coil 21 of the operating region 20, allowing the user interface element 33 configured as an LCD for example to be operated.

Figure 4A:
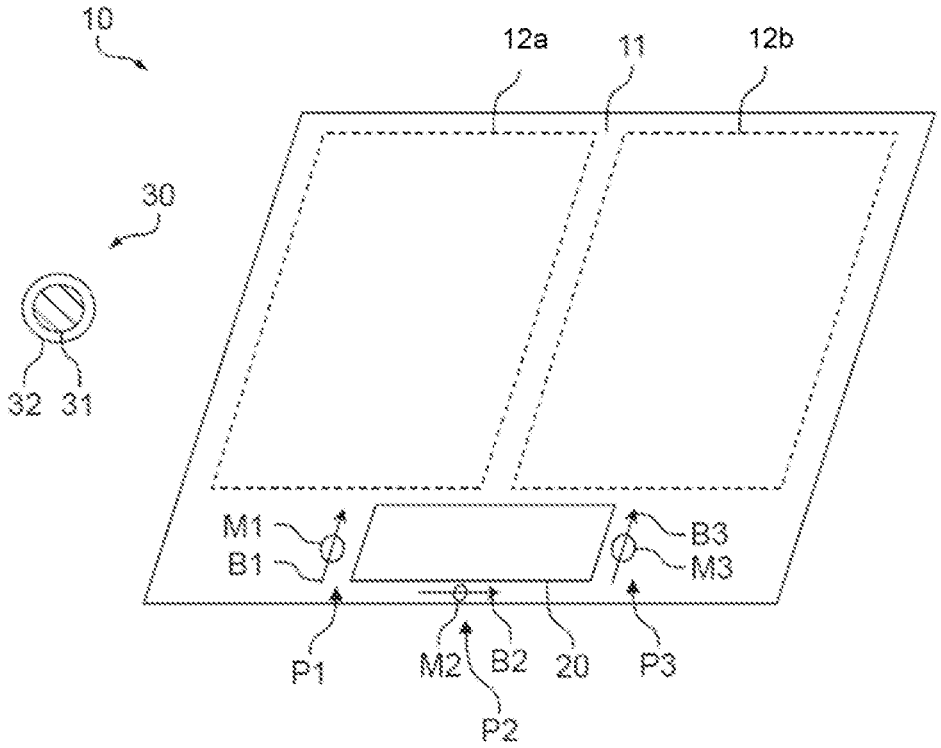
FIGS. 4*a* to 4*c* show a schematic view of an exemplary embodiment of a household appliance configured as a cooktop with an operating region and an operating element.

FIG. 4*a* shows a schematic view of a further exemplary embodiment of a household appliance 10, configured here as an induction cooktop 11. The induction cooktop 11 has two cooking zones 12*a*, 12*b* and an operating region 20, to which three predefining apparatuses M1, M2, M3 are assigned. The predefining apparatuses M1, M2, M3 are configured as ring magnets here, each of the ring magnets M1, M2, M3 having its own magnetic field B1, B2, B3. The regions on the ring magnets M1, M2, M3 in this example are preferred positions P1, P2, P3 for the operating element 30. The operating element 30 is shown away from the induction cooktop 11 in FIG. 4*a*. It has an inner element 31 and an outer element 32. The inner element 31 has a user interface element 33 and a magnetic body 34 configured as a ring magnet, which has not been shown in FIG. 4*a* for reasons of clarity (see for example FIGS. 2*a* and 2*b*). The alignment of the inner element 31 is indicated by cross-hatching. In the initial position in FIG. 4*a* the inner element 31 is aligned at an arbitrary angle to the induction cooktop 11.

Figure 4B:
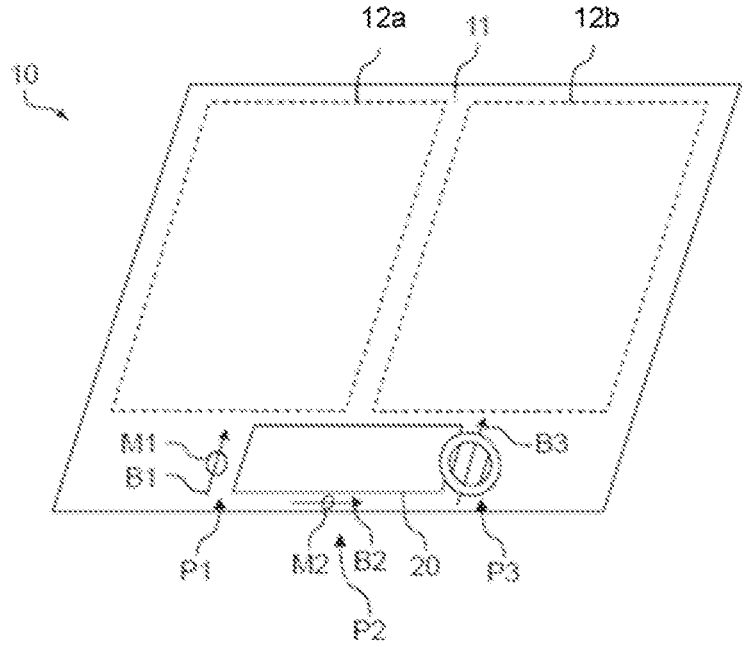

If a user now wishes to activate the right cooking zone 12*b* of the induction cooktop 11, said user positions the operating element 30 for example in position P3 on the operating region 20, as shown in FIG. 4*b*. As shown by the hatching of the inner element 31 of the operating element 30, the inner element 31 has aligned itself according to the magnetic field B3 predefined by the ring magnet M3 as it is brought toward the position P3. This ensures that an operating parameter is displayed on the user interface element 33 correctly and in such a manner that it can be read reliably by the user. The reference characters for the operating element 30 and the features associated with the position P3 are not shown in FIG. 4*b* in order not to overload the diagram.

Once the user has for example set a cooking stage for the right cooking zone 12*b* of the induction cooktop 11 by means of the operating element 30, said user may wish to input a cooking time for example. To this end, a provision can be made for the user to remove the operating element from the position P3 and reposition it in the position P2. The magnetic body M2 characterizing the position P2 has a magnetic field B2, which is aligned perpendicular to the magnetic field B3 of the magnet M3 in the example. Therefore, the alignment of the inner element 31 of the operating element 30 also changes, when the operating element 30 is brought toward the position P2, as shown by the hatching of the inner element 31. The reference characters for the operating element 30 and the features associated with the position P2 are not shown in FIG. 4*c* in order not to overload the diagram.

Figure 4C:
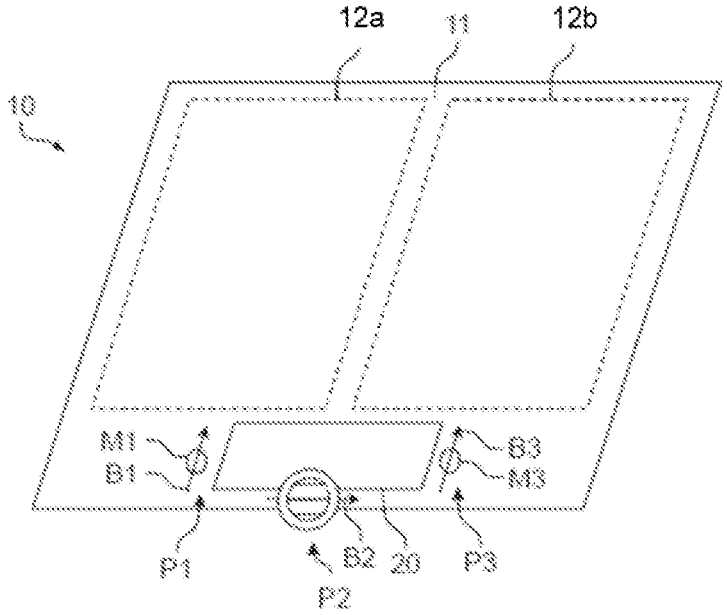
Figure 5:
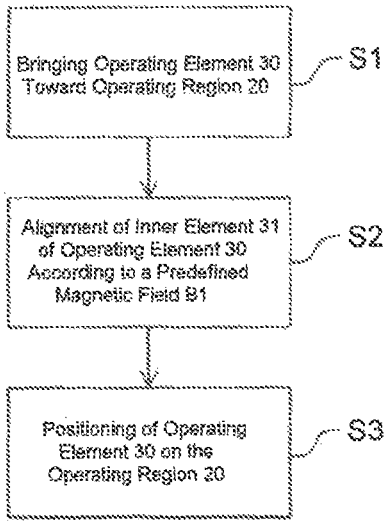
FIG. 5 shows an exemplary embodiment of a method for controlling a household appliance.

FIG. 5 shows an exemplary embodiment of a method for controlling a household appliance 10 with an operating region 20, for example the household appliance 10 in FIG. 1 or the induction cooktop 11 in FIGS. 4*a*-4*c*.

In step S1 of the method, an operating element 30 is brought toward the operating region 20 of the household appliance 10. The operating region 20 has a magnetic body M1 with a magnetic field B1. The operating element 30 has a two-part structure with an inner element 31 and an outer element 32. The inner element 31 has a user interface element 33 and a magnetic body 34.

In step S2 of the method the inner element 31 of the operating element 30 is aligned according to the predefined magnetic field B1. This takes place in particular when the operating element 30 is at a distance of around 20 mm to 1 mm from the operating region 20.

In step S3 the operating element 30 is positioned on the operating region 20 and can then be used to operate the household appliance 10. Operate here means that for example an operating parameter of the household appliance 10 is displayed to a user by means of the user interface element 33 of the operating element 30 and/or a user input is acquired to control the household appliance 10. The household appliance 10 is first activated for example by pressing the outer element 32 of the operating element 30. A function of the household appliance 10, for example an oven or cooking zone 12*a*-12*d*, is then selected by rotating the outer element 32. Selection can take place for example by showing a graphic display on the operating region 20 and/or on the user interface element 33. The currently selected function can be activated for example by pressing the outer element 32 again. A current cooking chamber temperature of the oven for example can then be displayed on the user interface element 33. To terminate the cooking operation, the operating element 30 is for example simply removed from the operating region 20 and moved to a rest position.

Although the present invention has been described based on exemplary embodiments, it can be modified in many different ways.

The invention claimed is:

1. A household appliance, comprising:

an operating region for controlling the household appliance; and an operating element configured for attachment on the operating region by magnetic force and removal therefrom and being movable relative to the operating region, said operating element including an outer element and an inner element which is rotatable relative to the outer element, said inner element including a user interface element and a magnetic body, by which the inner element is capable of being aligned relative to the outer element by a predefined magnetic field, wherein the operating element is secured on the operating region by a magnetic retaining force, wherein the predefined magnetic field of the magnetic body has a defined direction, and wherein the inner element of the operating element is capable of rotating relative to the outer element and is capable of being rotationally aligned with respect to a particular control location of the operating region by the predefined magnetic field having the defined direction when the operating element is being secured on the operating region, thereby aligning the user interface element of the inner element with the particular control location of the operating region.

2. The household appliance of claim 1, wherein the operating region and the user interface element of the operating element are configured as a function of a position of the operating element relative to the operating region.

3. The household appliance of claim 1, wherein the magnetic body of the operating element is configured as a ring magnet.

4. The household appliance of claim 1, wherein the magnetic body of the operating element is configured as a bar magnet or a curved bar magnet.

5. The household appliance of claim 1, further comprising a predefining apparatus provided in the operating region for predefining the magnetic field.

6. The household appliance of claim 5, wherein the predefining apparatus is configured as a magnetic body corresponding to the magnetic body of the operating element.

7. The household appliance of claim 5, wherein the predefining apparatus and the magnetic body of the operating element are matched such that alignment of the inner element of the operating element by the predefined magnetic field takes place when the operating element is at a distance of 1-20 mm from the operating region.

8. The household appliance of claim 7, wherein the distance is 5-15 mm.

9. The household appliance of claim 1, wherein the outer element of the operating element is rotatable relative to the inner element of the operating element, when the operating element is positioned on the operating region.

10. The household appliance of claim 1, wherein the user interface element includes a display configured to display an operating parameter of the household appliance graphically.

11. The household appliance of claim 10, wherein the display is configured as a touch-sensitive display.

12. The household appliance of claim 1, wherein the inner element of the operating element includes an energy supply apparatus to supply the user interface element with electrical energy.

13. The household appliance of claim 12, wherein the energy supply apparatus includes a charging coil, said operating region including a transmit coil for transfer of electrical energy inductively to the charging coil.

14. The household appliance of claim 1, wherein the inner element is radially inward of the outer element.

15. An operating element for operating a household appliance, comprising:

an outer element; and an inner element, which is radially inward of the outer element and rotatable relative to the outer element, said inner element including a user interface element and a magnetic body, by which the inner element is capable of being aligned relative to the outer element by a predefined magnetic field, wherein the operating element is configured to be secured on an operating region of the household appliance by a magnetic retaining force, wherein the predefined magnetic field of the magnetic body has a defined direction, and wherein the inner element of the operating element is configured to rotate relative to the outer element to rotationally align with respect to a particular control location of the operating region by the predefined magnetic field having the defined direction when the operating element is being secured on the operating region to thereby align the user interface element of the inner element with the particular control location of the operating region.

16. The operating element of claim 15, wherein the operating element is embodied as a removable rotary knob.

17. The operating element of claim 15, wherein the user interface element is configured as a function of a position of the operating element relative to the operating region of the household appliance.

18. The operating element of claim 15, wherein the magnetic body is configured as a magnet selected from the group consisting of a ring magnet, a bar magnet, and a curved bar magnet.

19. The operating element of claim 15, wherein the outer element is configured to be rotatable relative to the inner element of the operating element when the operating element is positioned on the operating region of the household appliance.

20. The operating element of claim 15, wherein the user interface element includes a display configured to display an operating parameter of the household appliance graphically.

21. The operating element of claim 20, wherein the display is configured as a touch-sensitive display.

22. The operating element of claim 15, wherein the inner element includes an energy supply apparatus to supply the user interface element with electrical energy.

23. The operating element of claim 22, wherein the energy supply apparatus includes a charging coil for receiving electrical energy inductively from a transmit coil of an operating region of the household appliance.

24. A method for controlling the household appliance of claim 1, said method comprising:

bringing the operating element toward the operating region to enable the operating element to be held on the operating region by magnetic force and to be moved relative to the operating region and to be positioned for removal therefrom;

aligning the inner element of the operating element according to the predefined magnetic field; and positioning the operating element on the operating region to operate the household appliance, thereby at least one of enabling display of an operating parameter of the household appliance and acquiring a user input to control the household appliance.

* * * * *